United States Patent [19]

Duwe et al.

[11] 3,938,773

[45] Feb. 17, 1976

[54] APPARATUS INCLUDING CAMMED FASTENING MEANS FOR MAKING MODULAR CRYPTS

[75] Inventors: Edward C. Duwe; William E. Duwe, both of Oshkosh, Wis.

[73] Assignee: Duwe Precast Concrete Products, Inc., Oshkosh, Wis.

[22] Filed: Oct. 15, 1974

[21] Appl. No.: 514,932

[52] U.S. Cl. ..... 249/27; 249/165; 249/172

[51] Int. Cl.[2] ..... B28B 7/22

[58] Field of Search . 249/50, 91, 93, 163, 165–172, 249/27

[56] References Cited

UNITED STATES PATENTS

| | | | |
|---|---|---|---|
| 800,643 | 10/1905 | Haffey | 249/93 |
| 942,092 | 12/1909 | May | 249/172 |
| 961,659 | 6/1910 | Taylor | 249/163 |
| 1,172,451 | 2/1916 | Hall | 249/165 |
| 1,580,281 | 4/1926 | Bowe | 249/93 |
| 1,905,897 | 4/1933 | Cahill | 249/93 |
| 2,486,038 | 10/1949 | Landon | 249/163 |
| 2,942,321 | 6/1960 | Pinter et al. | 249/170 |
| 3,071,836 | 1/1963 | Tumey | 249/50 |
| 3,348,802 | 10/1967 | Corbett | 249/172 |
| 3,625,468 | 12/1971 | Marcott | 249/165 |

FOREIGN PATENTS OR APPLICATIONS

| | | | |
|---|---|---|---|
| 633,291 | 1/1928 | France | 249/166 |

OTHER PUBLICATIONS

General Catalog; Form–Crete Steel Forms, 1959, pp. 1–4.

*Primary Examiner*—Francis S. Husar
*Assistant Examiner*—John McQuade
*Attorney, Agent, or Firm*—Wigman & Cohen

[57] ABSTRACT

An apparatus for casting reinforced concrete modular crypts for use in constructing a substantially monolithic mausoleum edifice. The casting apparatus includes a frame having a plurality of vertically disposed generally U-shaped brackets attached thereto and a plurality of longitudinal members connecting the brackets which support a flexible, shaped sheet metal casting form. The frame is provided with upright sides or doors, at least one of which is hingedly mounted to the frame. A plurality of arm members attached exteriorly to the casting form engage slots or openings in the hingedly mounted door which is forcibly urged into engagement with the edges of the casting form to enclose the form prior to introduction of a fluent casting material. The casting form is sufficiently rigid to support the casting material without deformation, yet sufficiently flexible to permit rapid extraction of the cast element therefrom with no damage to either the form or element.

9 Claims, 8 Drawing Figures

FIG. 4
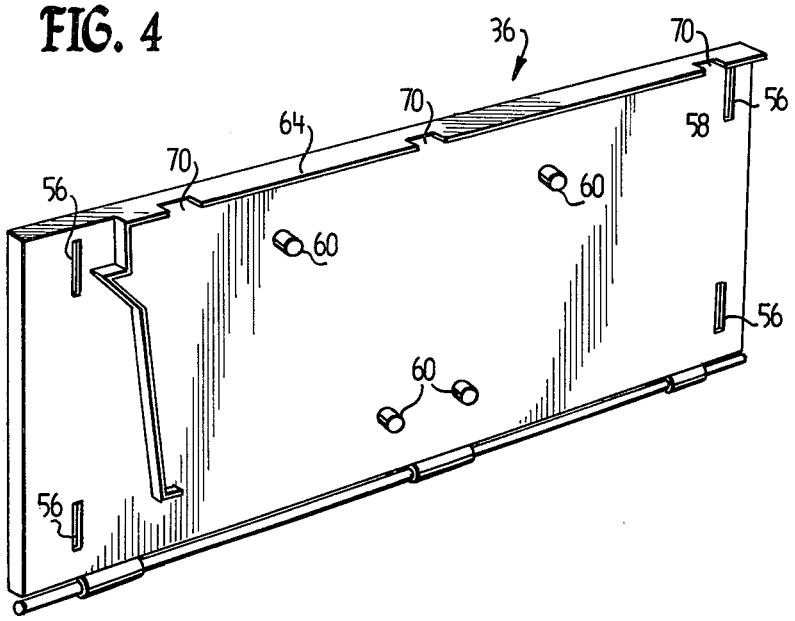
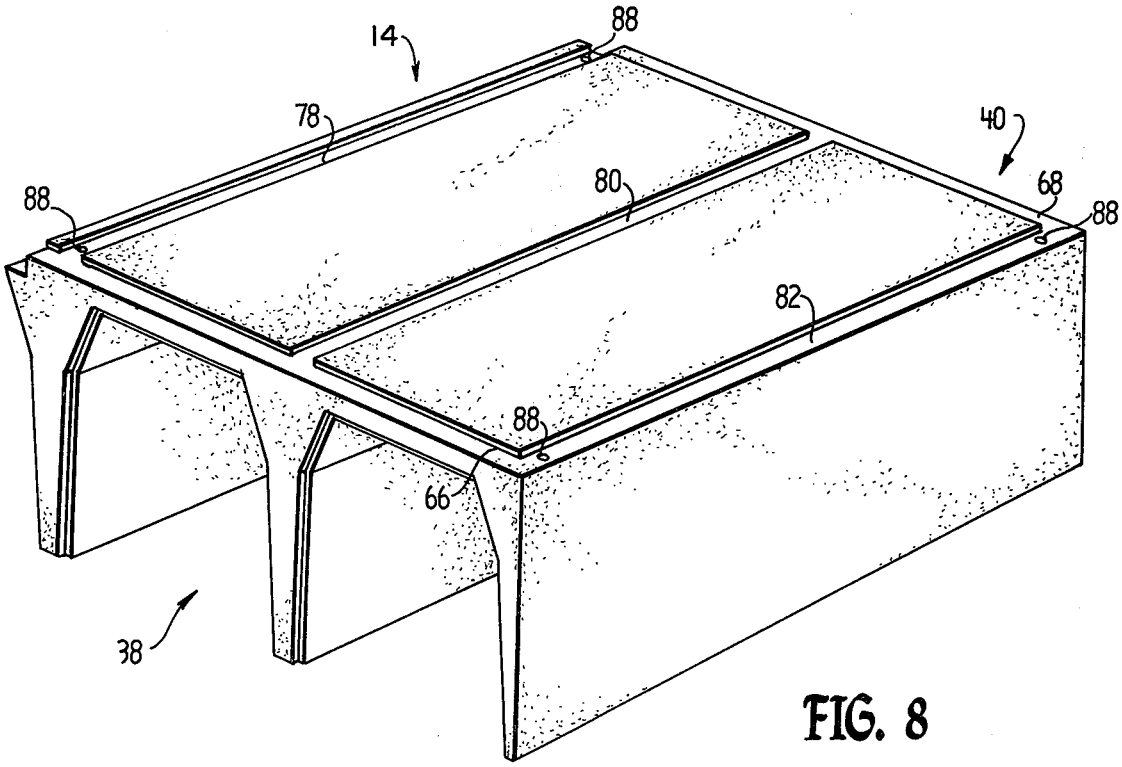
FIG. 8

APPARATUS INCLUDING CAMMED FASTENING MEANS FOR MAKING MODULAR CRYPTS

BACKGROUND OF THE INVENTION

1. Field of the Invention

This invention relates to an apparatus for casting concrete structural elements. More particularly, the invention relates to an improved casting apparatus for economically casting reinforced concrete crypts for use in substantially monolithic mausoleum structures, of the type disclosed in our copending patent application Ser. No. 459,299, filed Apr. 9, 1974, and entitled "Modular Mausoleum Crypt System," now U.S. Pat. No. 3,878,656, the description of which is incorporated herein by reference.

1. Description of the Prior Art

In recent years there has been increasing emphasis placed on the efficient utilization of land, especially for burial purposes, in areas where the population growth has been significant. One particular pressing problem which has received attention for at least the past two decades is the use of above-ground mausoleums, similar in concept to highrise apartments. The advantages of the above-ground, multi-level mausoleums are readily seen since this concept permits a more efficient utilization of land and has the added advantage of permitting visitors to be indoors while paying respects to the deceased, where lobby-like facilities are provided.

Heretofore, a variety of construction techniques have been employed to construct multi-level, above-ground mausoleums. One such technique utilizes the "poured-in-place" technique used in apartment construction. Thus, concrete is poured in forms on the site, level by level, until the entire structure is completed. In this manner, a multi-story mausoleum can be fabricated according to design. This approach yields a highly satisfactory product but is economically undesirable by virtue of the slow and relatively expensive fabrication technique employed.

The various techniques for casting concrete structural elements in a shaped form are known. One approach for casting relatively large reinforced concrete components is to initially fabricate a wooden form and cast therein a concrete pattern of the shape of the ultimately desired component. A final concrete form is then fabricated by pouring concrete within a wall constructed around the concrete pattern which is removed when the form sets. A significant disadvantage of this technique is that the concrete form is entirely inflexible. Unless very accurately controlled drafts of substantial magnitudes are used, removal of the cast component from such an inflexible concrete form results in damage to the form or the cast component, or both.

Others have utilized forms fabricated from metal plate for casting concrete structural elements. However, this approach utilized rigid, heavy metal plates to prevent deformation of the form and consequent difficulty in releasing the element as well as undesirable dimensional distortion thereof. Even though a degree of form flexibility is achieved with a metal plate form, release and removal of the element is still time-consuming and did not prove satisfactory in all cases involving complex shapes.

To overcome some of the foregoing difficulties encountered when removing a cast concrete element from a form, others have suggested the use of a plurality of separate and detachable sections which, when assembled, receive the poured concrete. To extract the finished element from the form, the form is broken down. Utilization of such forms is obviously time-consuming and unless the mating sections of the form are well fitted and reasonably rigid, the fluent casting material will leak out from the form at the adjoining surfaces of the sections. This disadvantageously results in rapid accumulation of concrete flash and debris on the assembly or production line.

OBJECTS AND SUMMARY OF THE INVENTION

In view of the foregoing, it should be apparent that a need still exists in the art for a reusable form for casting reinforced concrete structural elements which is characterized by sufficient rigidity to prevent distortion of the form surface during pouring, yet sufficiently flexible to permit rapid extraction of the cured element from the form without damage to either the form or element. It is, therefore, a primary object of the present invention to provide a novel and improved form for economically casting reinforced concrete structural elements which is constructed to facilitate rapid release and removal of the cast element and concomitantly to minimize damage to the element.

More particularly, it is an object of the invention to provide a casting form fabricated of relatively light gauge sheet metal supported on its underside by a novel arrangement of support elements so as to achieve sufficient rigidity and prevent significant form distortion yet maintain a high degree of flexibility for rapid extraction of the element from the form.

Still more particularly, it is an object of the invention to provide a casting form which incorporates and combines in a novel manner advantageous aspects of the structure of a one-piece or unitary form with similar aspects of a multi-section form and eliminates the aforementioned disadvantages of both.

Another object of the present invention is to provide a casting form for a concrete element utilizing at least one hingedly mounted form section which may be pivoted away from the cast element to facilitate its removal and further which may be securely sealed against mating form sections by a camming arrangement.

Yet another object of the invention is to provide an improved apparatus for casting reinforced concrete structural elements on an assembly line which largely eliminates the undesirable accumulation of concrete flash or debris.

Briefly described, these and other objects of the invention are accomplished by a casting apparatus according to the present invention comprising a sturdy, rectangular frame or base for supporting a plurality of generally U-shaped upright brackets arranged in parallel relation in one or more rows beneath a lightweight sheet metal form of predetermined configuration conforming to the shape of the modular crypt being cast. A plurality of longitudinal stiffening members disposed perpendicularly of the brackets and located in cutouts provided on the bracket edges confronting the sheet metal form are affixed to the underside surfaces of the form. A pair of end doors, at least one of which is hingedly mounted at its lower portion to the frame, are arranged oppositely of each other to close off the form cavity at the end thereof. Each end door is provided with a plurality of slots or openings for engaging respective arm members connected to and extending from locations on the underside of the sheet metal form. Camming means are arranged in at least two vertically spaced horizontal planes for urging the end doors sealingly against the mating edges of the sheet metal form and the edges of the fixedly mounted oppositely disposed walls of the form, prior to introducing the fluent casting material therein. The engagement of the arm members on the form with the slots or openings on the end doors aids significantly in rigidifying the form prior to introduction of the fluent casting material.

After filling the form cavity, lifting holes are provided at predetermined spaced locations by inserting and then removing a pin into the top surface of the partially set casting material at an angle with respect to the vertical. Upon setting of the casting material, the end door cams are released, permitting at least one of the end doors to be pivoted away from the form, thereby disengaging the arm members from the slots or openings in the doors.

To remove the cast element from the form, Lewis pins, connected via four slings to a hoisting device, are inserted in each of the four holes provided in the upper surface of the cast element. With the end doors hinged out of engagement with the arm members of the form, the flexibility thereof is additionally improved over that achieved by the novel arrangement of the U-brackets and angle members alone, so as to permit rapid extraction of the element vertically from the form with no damage to either the form or the cast element.

Another important feature of the invention relates to the fabrication of the sheet metal form surface. When possible, of course, it is desirable to construct the form surface of a single continuous sheet metal member. If, however, welds are necessary in the form surface, it was found highly advantageous to locate the welded seam along the bottom of the form surface, i.e., the lowermost portion of the form cavity corresponding to the leg portion of the modular crypt being cast. This construction prevents the cast element from hanging up on the weld line during extraction.

Other objects, advantages and features of the invention relate to structural details and novel combinations and arrangements thereof which will become hereinafter apparent when considered in conjunction with the accompanying drawings wherein:

BRIEF DESCRIPTION OF THE DRAWINGS

FIG. 4 shows a perspective view of the inwardly facing side of a second hingedly mounted end door;

FIG. 8 is a perspective view of one form of a crypt module cast in the apparatus of FIG. 1.

DETAILED DESCRIPTION OF A PREFERRED EMBODIMENT

Figure 1:
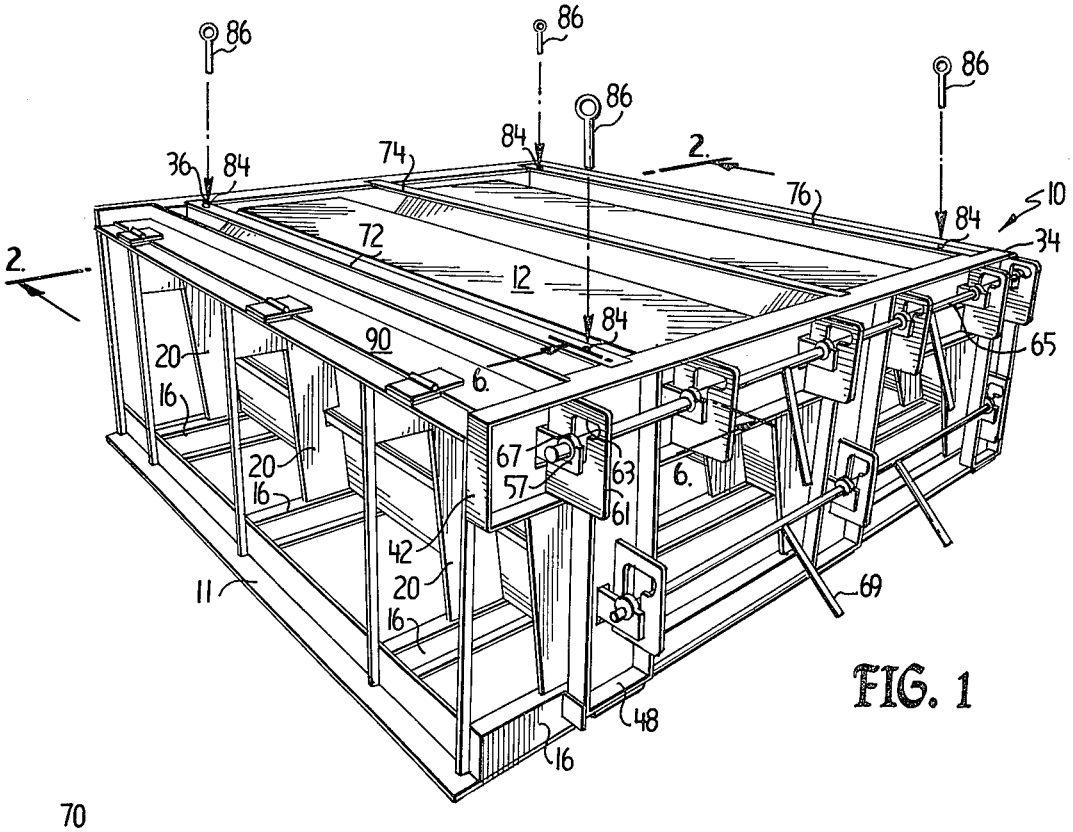
FIG. 1 shows a view in perspective of the casting apparatus of the present invention.
Figure 2:
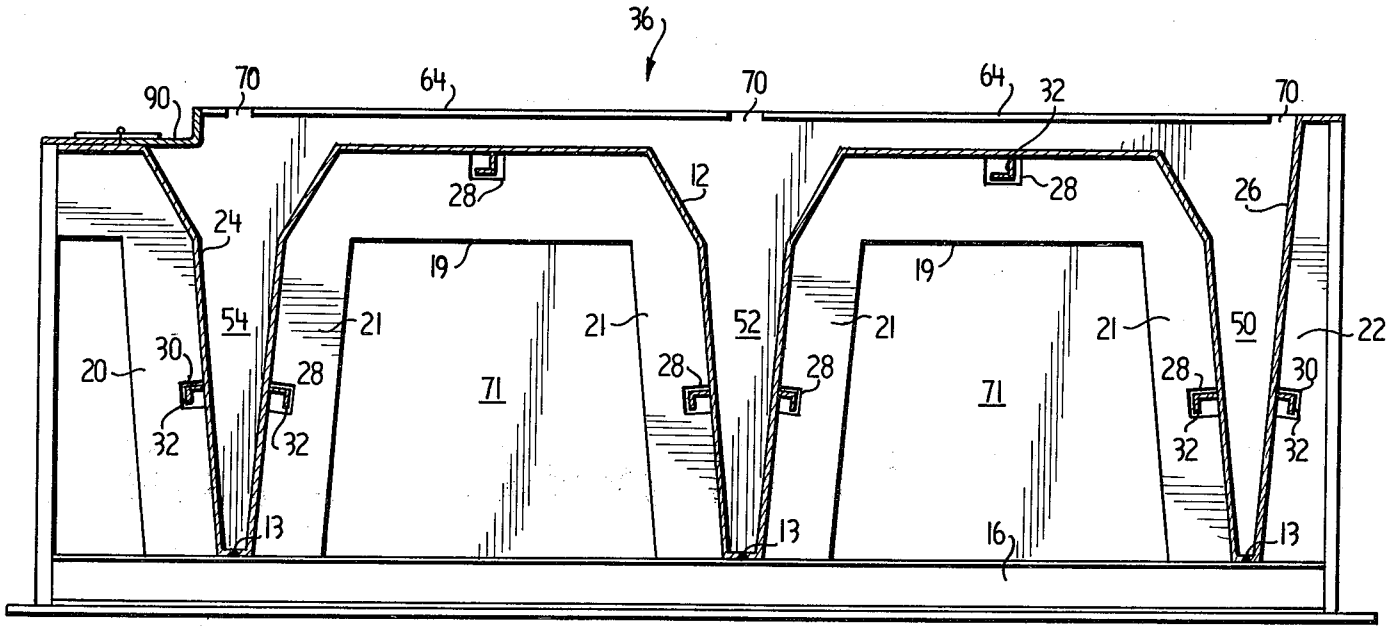
FIG. 2 is a view in cross-section of the casting apparatus taken along section 2—2 of FIG. 1.

Referring now in detail to the drawings, wherein like parts are represented throughout with like reference numerals, FIG. 1 shows a preferred embodiment of the casting apparatus 10 according to the present invention. The casting apparatus 10 includes a rigid rectangular frame or base 11, which may be constructed of rolled-steel channel or other suitable structural members, which in turn supports an internally positioned sheet metal casting form or support 12, with a predetermined cross-section as shown in FIG. 2. Although the form 12 is shown to be configured for casting the crypt module 14 of FIG. 8, it is to be understood, however, that the form 12 may be configured for casting other reinforced concrete elements, as for example, the crypt modules designated A, B and D, and illustrated in FIG. 3 of the aforementioned U.S. Pat. No. 3,878,656.

The sheet material of the form 12 of the embodiment described herein is preferably formed of a single sheet of standard 11-gauge stock. If a single sheet is unavailable or cannot be properly shaped with available forming means, the casting form may be provided with welded seams. It is important, however, that the weld be so located to avoid hanging up of the cast element in the form. A preferred weld location is shown in FIG. 2 at the lowermost portions of the form 12 designated by reference numeral 13.

Figure 5:
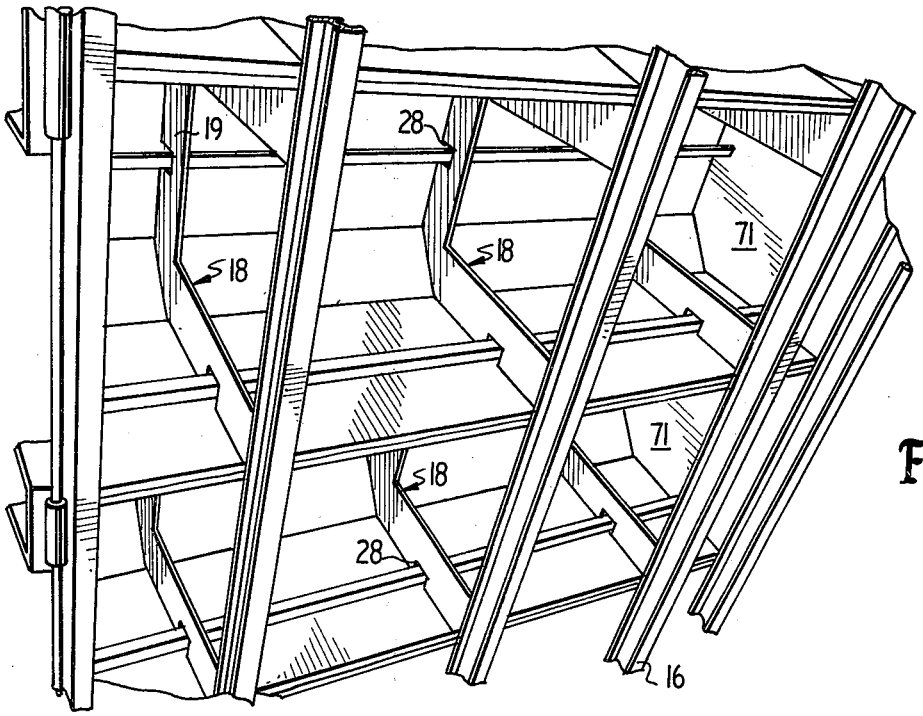
FIG. 5 shows a view in perspective of the exterior side of the casting form as viewed from beneath the casting apparatus of FIG. 1.

Referring now to FIGS. 2 and 5 there is illustrated stiffening means which are positioned interiorly of casting apparatus 10 below the sheet metal form 12 and in substantially adjacent relationship.

Base 11 includes attached channel members 16. A plurality of upright, generally U-shaped brackets 18 fabricated of sheet metal and arranged in spaced relation in two parallel rows beneath the form 12 are provided. Each of the U-shaped brackets 18 includes an upper portion 19 and upright side portions 21. Also provided are side brackets 20, 22 in spaced relation in planes coincident with the rows of brackets 18. Side brackets 20, 22 are arranged to support the outermost walls 24, 26, respectively, of the form 12. Each bracket 18 has three generally rectangular cutouts or notches 28 in its outwardly disposed edges confronting the exterior of the form 12. One cutout 28 is positioned centrally of the upper portion 19 and the other two notches are located approximately midway along the depending side portions 21. Each side bracket 20, 22 is similarly provided with a cutout 30 positioned approximately midway along its edge confronting the walls 24, 26 of the form 12. Angle brackets 32 are disposed perpendicularly of brackets 18, 20, 22 in the corresponding cutouts of the bracket rows.

Referring now to FIGS. 1 and 2, the form 12 is provided with three open-ended longitudinal wall cavities 50, 52, 54 for receiving the casting material. When the casting material is introduced, the open ends of cavities 50, 52, 54 are closed by the end doors 34, 36. The end doors 34, 36 are positioned at the ends of the form 12 corresponding to the front 38 and rear 40, respectively, of crypt module 14.

Figure 3:
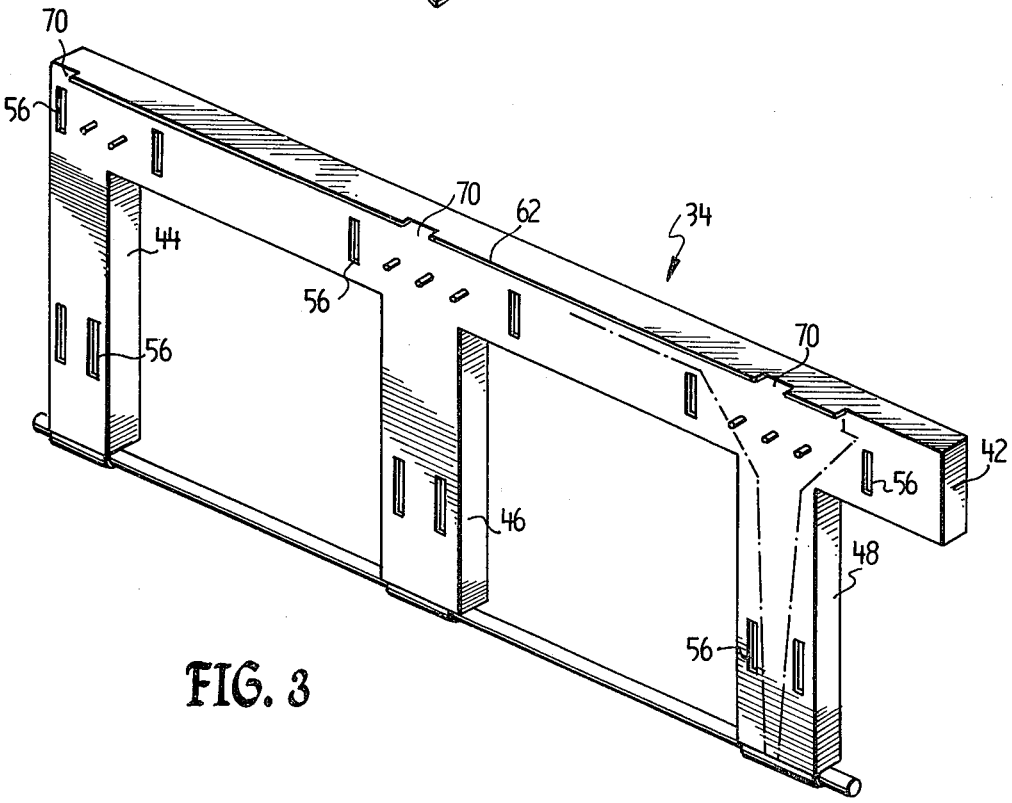
FIG. 3 shows a perspective view of the inwardly facing side of one hingedly mounted end door.

In FIG. 3, there is shown end door 34 which is formed of longitudinal channel member 42, and vertical channel members 44, 46, 48, laterally spaced to confront the open ends of wall cavities 50, 52, 54, respectively, of form 12. The end door 34 is hingedly mounted to the base 11 via the bottom surfaces of channels 44, 46, 48 to permit end door 34 to be pivoted away from the end of form 12 when removing a hardened cast element. A plurality of spaced slots or openings 56 are arranged in two vertically spaced parallel rows, the first row of slots being disposed in longitudinal channel member 42, the second row in vertical channel members 44, 46, 48.

Figure 6:
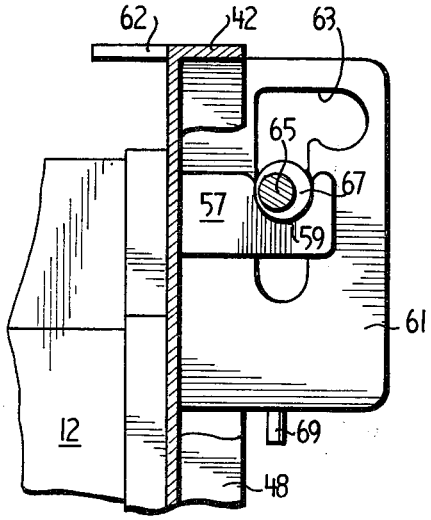
FIG. 6 shows a partially broken side view of the cam means of the invention taken along sections 6—6 of FIG. 1.
Figure 7:
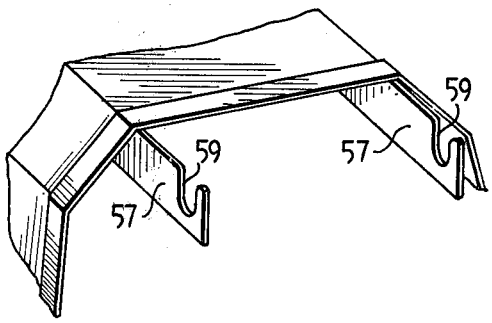
FIG. 7 is a perspective view of a portion of the casting form confronting the end door of FIG. 3.

The slots 56 are arranged to receive penetrating arm members 57 projecting laterally from opposite ends of the casting form, as best seen in FIGS. 6 and 7. Each arm member 57 is provided with a U-shaped cam slot 59 disposed in the upwardly oriented edge thereof and of a size which conforms with the opening 63 in the adjacent parallely disposed cam plates 61 of channel members 42, 44, 46, 48. Each of the cam plates 61 includes an inverted L-shaped opening 63, the long portion of which is arranged generally vertically. The vertical portion of the opening 63 is disposed adjacent the cam slot 59 of the arm member 57 when the end doors 34, 36 are in the upright position. Elongated cam bars 65 are located in the aligned openings 63 of each row of cam plates 61. Axially spaced along the cam bars 65 at the locations of the arm members 57 and slots 56 are eccentric cams 67. With the cams 67 engaged in the cam slots 59 of the arm members 57 and rotated into the position shown in FIG. 6 by cam bar handles 69, the end doors 34, 36 are sealingly urged against the mating surfaces of the casting form 12. End door 36 is provided with a similar cam means for each slot 56 therein.

The engagement of the arm members 57 with the slots 56 is especially advantageous in rigidifying the end of the casting form 12 confronting end door 34. The end of the form 12 confronting end door 36 is, of course, made rigid by the end walls 71 thereof. The above described arrangement of stiffening elements, including end walls 71, brackets 18, 20, 22, 32 and arm members 57 engaging slots 56 has been found to provide sufficient rigidity to the sheet metal casting from 12 to prevent distortion thereof when the form is filled with the cementitious casting material, and still exhibit sufficient flexibility to permit rapid extraction of a cast crypt module 14 after the casting material has set or hardened. It is apparent that the end doors and casting form of the apparatus 10 could be configured otherwise than as depicted in FIG. 1. For example, both oppositely disposed end doors and their cooperating elements could be in the form of end door 34 or end door 36.

In FIG. 4, end door 36 is constructed of a flat plate member 58 hingedly mounted at its lower portion to the base 11. Four slots 56 are provided in end plate 36, two at each end thereof in vertically spaced relation. End door 36 is spaced from the end of form 12 to provide a solid wall member at the rear end 40 of the crypt module 14. Pins 60 are arranged in predetermined locations to form blind holes in the solid rear wall of module 14 in a known manner.

Each end door 34, 36 is provided with overhanging flange members 62, 64 which form the grooves 66, 68 in the front and rear, respectively, of the top surface of crypt module 14. Each flange member 62, 64 is provided with three spaced notches 70 for receiving three longitudinal strips 72, 74, 76 which are inserted in the notches 70, as shown in FIG. 1, subsequently of pouring the casting material into the form 12, and after the material has partially set. The strips 72, 74, 76 are arranged to form the longitudinal grooves 78, 80, 82 in the top surface of crypt module 14. Each end of the strips 72 and 76 is provided with an aperture 84 located so that the diagonals therebetween intersect at a point which is substantially coincident with a vertical line through the center of gravity of a crypt module 14 in the form 12.

To prepare the casting apparatus 10 for receiving a fluent casting material, a suitable reinforcing material is inserted in the leg cavities 50, 52, 54. The hingedly mounted portion 90 of the casting apparatus 10 is next positioned over the leg cavity 54, as shown in FIG. 2, and secured in place by fastening means (not shown). The end doors 34, 36 are pivoted generally upwardly toward the form 12. As the end doors 34, 36 approach the upright position, the arm members 57 penetrate the slots 56 and extend therethrough to the exterior side of the end doors. The cam bars 65 are then positioned in the vertical portion of the opening 63 in plates 61 so that cams 67 engage the cam slots 59 of the arm members 57. The cam bar handles 69 are then rotated downwardly about the cam bar axis so as to urge the end doors 34, 36 sealingly against the mating portions of the casting form 12. The cementitious casting material is introduced by conventional means into the casting apparatus 10 which, if desired, may be agitated by vibration means (not shown) to insure complete filling of the casting form and removal of undesirable air voids which may have been entrapped during pouring. The casting material is poured to a level substantially coincident with the plane of the top surface of the casting apparatus 10. Strips 72, 74, 76 are then located in notches 70 of the flanges 62, 64 of the end doors 34, 36, as hereinbefore described. To accelerate the hardening of the poured-in-place concrete, heating coils or pipes can be placed beneath the frame to convey heat upwardly into the concrete through the form 12. Alternatively, the poured concrete can be air-cured without heat, although a longer time would be required, 3 days compared against 1 day.

When the concrete has partially set, pins 86 are inserted through respective apertures 84 into the casting material. Preferably, the axis of each pin is disposed in diagonal planes through the holes 84 and forms an angle of approximately 45° with the vertical. Thereafter, the pins 86 are removed, leaving four angularly oriented blind holes 88 in the top surface of a cast crypt module 14.

After the casting material has completely set, the strips 72, 74, 76 are removed, hingedly mounted form portion 90 is unfastened and pivoted upwardly about its hinged axis to its full open position, and end doors 34, 36 are pivoted away from the form 12 after releasing the cam means. To remove the cast element 14 from the form 12, a hoisting apparatus is brought into position over the casting apparatus 10. A hoisting sling (not shown) made up of four cables or chains of equal length, each attached at one end to a ring and having a Lewis pin secured at the free ends thereof, is attached to the free terminus of the hoisting cable. The Lewis pins are inserted in the angularly disposed holes 88 in the cast element and the hoisting cable is tensed to cause a frictional engagement of the Lewis pins internally of the holes 88. The crypt module 14 may now be extracted from the casting form 12 by raising the hoisting cable vertically. Although it is preferred that the hoisting cable axis coincide with a vertical line through the center of gravity of the module 14, the casting form 12 is sufficiently flexible to permit some variation between the lifting axis and center of gravity without damage to either the form 12 or the cast element 14.

Many modifications and variations in the present invention, other than those described herein, are possible in light of the above teachings and within the purview of the appended claims, without departing from the spirit and intended scope of the invention.

What is claimed:

1. Apparatus for casting reinforced concrete crypt modules comprising;

a base;

a shaped casting form supported on said base for receiving fluent casting material therein, one end of said casting form being open;

an end door pivotally mounted to said base in confronting relation with the open end of said casting form, said end door having spaced slots extending therethrough; and means mounted to said end door and said casting form for urging said end door sealingly against the open end of said casting form;

said means including spaced arm members positioned at the open end of said casting form and arranged to penetrate a respective slot in said end door, each arm member having a cam slot disposed in the penetrating end thereof, spaced cam plates affixed to said end door, each of said cam plates positioned adjacent a respective slot in said end door and having an opening therethrough, cam bar means having axially spaced cams thereon and extending through the openings of at least two cam plates, said cams being disposed in said cam slots of each of said arm members.

2. The apparatus according to claim 1 wherein said casting form is further supported by a plurality of upright brackets secured to said base and a plurality of angle brackets affixed perpendicularly of said upright brackets.

3. The apparatus according to claim 1, including means for forming spaced holes in the upper surface of the material cast, including at least two strips positioned in predetermined locations on said apparatus in overlying relation to said casting form, each strip having at least two apertures, four of said apertures defining a rectangle such that vertical planes through the diagonals of the rectangle intersect at a line subsubstantially coincident with a vertical line through the center of gravity of a module cast in said casting form.

4. The apparatus according to claim 3 including pins for insertion through a respective one of said four apertures into the top surface of the cast material, the axis of each of said pins forming an acute angle with a vertical line through the aperture, associated therewith.

5. The apparatus according to claim 1 wherein the end door slots are arranged in at least two spaced lines in said end door.

6. The apparatus according to claim 1 wherein said casting form is fabricated of flexible sheet metal.

7. The apparatus according to claim 6 wherein said flexible sheet metal casting form defines at least two spaced longitudinal wall cavities, each having a closed bottom and a lower and upper portion, the sides of the lower portion of each wall cavity from the bottom thereof being divergent upwardly at a first angle to form a wall of the cast module, the sides of the upper portion of each wall cavity from the lower portion thereof being divergent upwardly at a second angle greater than said first angle, to thereby form a thickened portion of said wall of the cast module.

8. The apparatus according to claim 1 wherein said casting form has a second open end and including a second end door pivotally mounted to said base in confronting relation with said second open end and means mounted to said second end door and said casting form for urging said second end door sealingly against the second open end of said casting form.

9. The apparatus according to claim 1 wherein said urging means includes lever means connected to said cam bar means for rotating said cam bar means whereby, upon actuation of said lever means, said bar means bears against said at least two cam plates and said cams bear against the cam slots of said arm members to thereby urge said end door toward the open end of said casting form.

* * * * *